US006461374B2

(12) United States Patent
Huang

(10) Patent No.: US 6,461,374 B2
(45) Date of Patent: Oct. 8, 2002

(54) PROTECTIVE PACIFIER NIPPLE STRUCTURE

(76) Inventor: Te-Ta Huang, No. 363, Sec. 2, Chang Ho Road, Ho Mei Chen, Chang hua Hsien (TW)

( * ) Notice: Subject to any disclaimer, the term of this patent is extended or adjusted under 35 U.S.C. 154(b) by 43 days.

(21) Appl. No.: 09/752,686

(22) Filed: Jan. 3, 2001

(65) Prior Publication Data

US 2002/0087191 A1 Jul. 4, 2002

(51) Int. Cl.[7] ..... A61J 17/00
(52) U.S. Cl. ..... 606/236
(58) Field of Search ..... 606/234–236

(56) References Cited

U.S. PATENT DOCUMENTS 3,363,630 A * 1/1968 Hines ..... 606/234
4,819,641 A * 4/1989 Russel et al.
4,878,496 A * 11/1989 Chen
5,366,481 A * 11/1994 Zade ..... 606/236

* cited by examiner

*Primary Examiner*—Eric F. Winakur
(74) *Attorney, Agent, or Firm*—Troxell Law Office PLLC

(57) ABSTRACT

A protective pacifier nipple structure having a nipple and a protective sleeve installed over the exterior section of the nipple. The nipple has situated at one side a nursing end and at the other side a round stay with a grasping ring. The round stay has fitted onto its outer periphery a protective sleeve with a serpentine tubular structure surrounding the nipple and, formed at the tail end of the protective sleeve and aligned with the position of the nursing end, is a through-hole. When the protective sleeve is collapsed, the nursing end of the nipple projects outside the through-hole and provides for the suckling of the infant. When the nipple is removed from the mouth of the infant, the protective sleeve is no longer compressed and the serpentine tubular structure elastically returns to its original shape, once again surrounding the nursing end of the nipple. As such, when the pacifier nipple is dislodged, the nursing end is prevented from contacting the floor, thereby functioning as a hygienic and safe protective pacifier nipple structure.

1 Claim, 4 Drawing Sheets

FIG3-A

PROTECTIVE PACIFIER NIPPLE STRUCTURE

BACKGROUND OF THE INVENTION

1) Field of the Invention

The invention herein relates to a protective pacifier nipple structure in which the nipple has fitted to the outer periphery of its round stay a protective sleeve that surrounds the nipple and, furthermore, is of a serpentine tubular structure; formed at the tail end of the protective sleeve and aligned with the position of the nursing end is a through-hole; as such, when the protective sleeve is collapsed, the nursing end of the nipple projects outside the through-hole and provides for the suckling of the infant; when the nipple is removed from the mouth of the infant, the protective sleeve immediately returns to its original shape, once again surrounding the nursing end of the nipple, such that when the pacifier nipple is dropped, the nursing end is prevented from contacting the floor, thereby functioning as a hygienic and safe protective pacifier nipple structure.

2) Description of the Prior Art

According to statistics, when sucking a nursing nipple, an infant is pacified and calmed and, moreover, crib death is averted; as such a nursing nipple is an indispensable infant product; however, as the infant is sucking the nipple, it is frequently expectorated unintentionally and falls onto the floor or is easily dropped due to imprudence by parents during removal; since in conventional nipple-type pacifiers, the nursing end of the nipple is directly exposed externally, the nursing end makes direct contact with the floor upon falling, becoming covered with unclean substances and bacteria such that when use of the pacifier is resumed, the frail still unvaccinated infant is subjected to contagious pathogens and the resultant diseases thereof.

In view of the said situation, the inventor of the invention herein conducted research, development, and design along with repeated testing and improvements that culminated in the successful development of the protective pacifier nipple structure of the present that entirely eliminates the drawbacks of the conventional product and, furthermore, is capable of significantly greater practicality.

SUMMARY OF THE INVENTION

The primary objective of the invention herein is to provide a protective pacifier nipple structure comprised of a nipple and a protective sleeve installed over the exterior section of the nipple, wherein the nipple has situated at one side a nursing end and at the other side a round stay; the round stay has fitted onto its outer periphery a protective sleeve, the said protective sleeve consisting of a serpentine tubular structure surrounding the nipple and, furthermore, formed at the tail end of the protective sleeve and aligned with the position of the nursing end is a through-hole; when the protective sleeve is collapsed, the nursing end of the nipple projects outside the through-hole and provides for the suckling of the infant; when the nipple is removed from the mouth of the infant, the protective sleeve is no longer compressed and the serpentine tubular structure instantly returns to its original shape, once again surrounding the nursing end of the nipple; and, as such, when the pacifier nipple is dislodged, the nursing end is prevented from contacting the floor, thereby functioning as a hygienic and safe protective pacifier nipple structure.

To enable a further understanding of the technological means, the resultant functions, and objectives of the invention herein, the general embodiment of the present invention is elaborated by the brief description of the drawings below and followed by the detailed description of the invention herein.

BRIEF DESCRIPTION OF THE DRAWINGS

FIG. 3-A is a cross-sectional view of the invention with the protective sleeve collapsed.

DETAILED DESCRIPTION OF THE INVENTION

Figure 1:
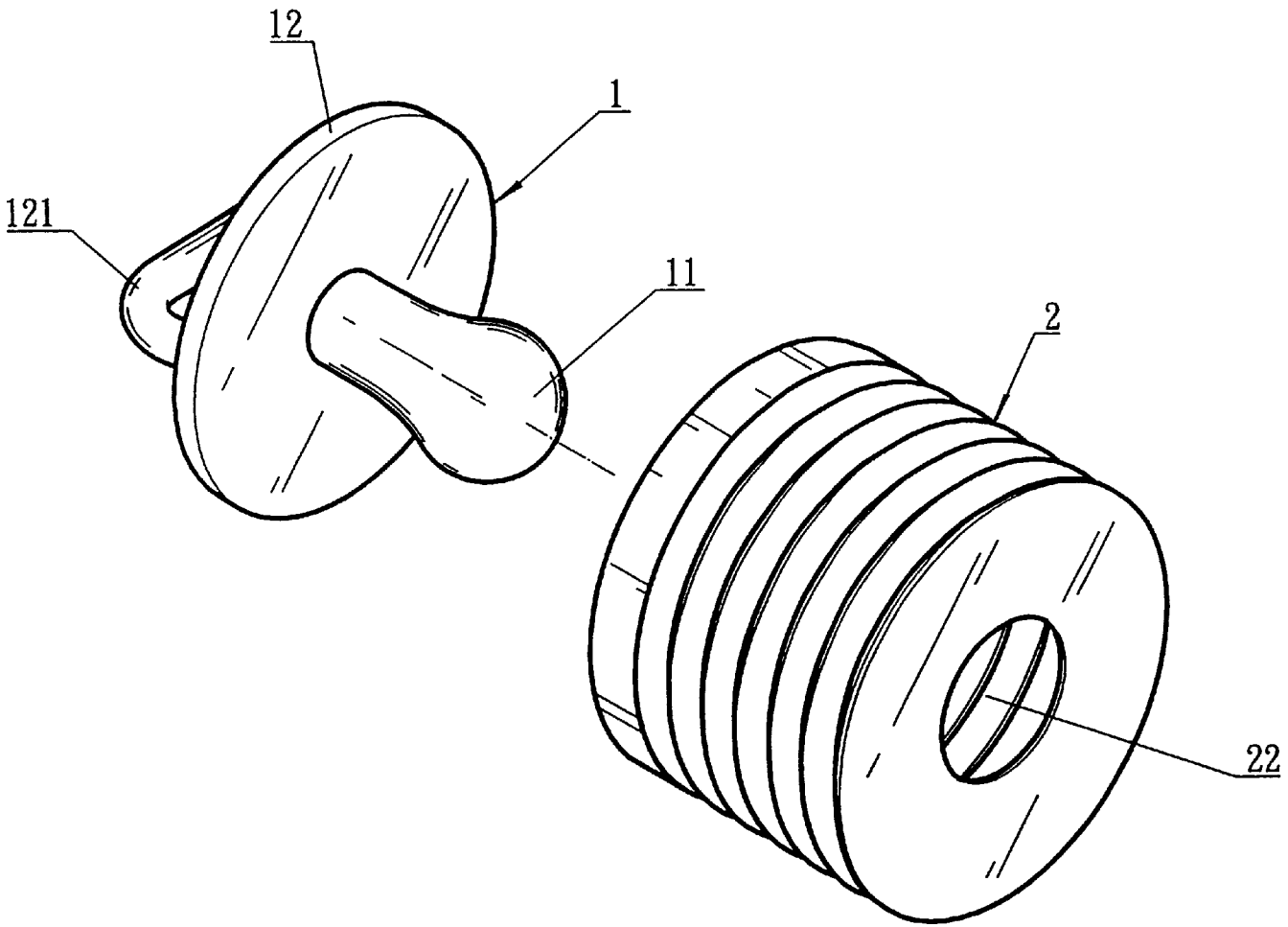
FIG. 1 is an exploded drawing of the invention herein.
Figure 2:
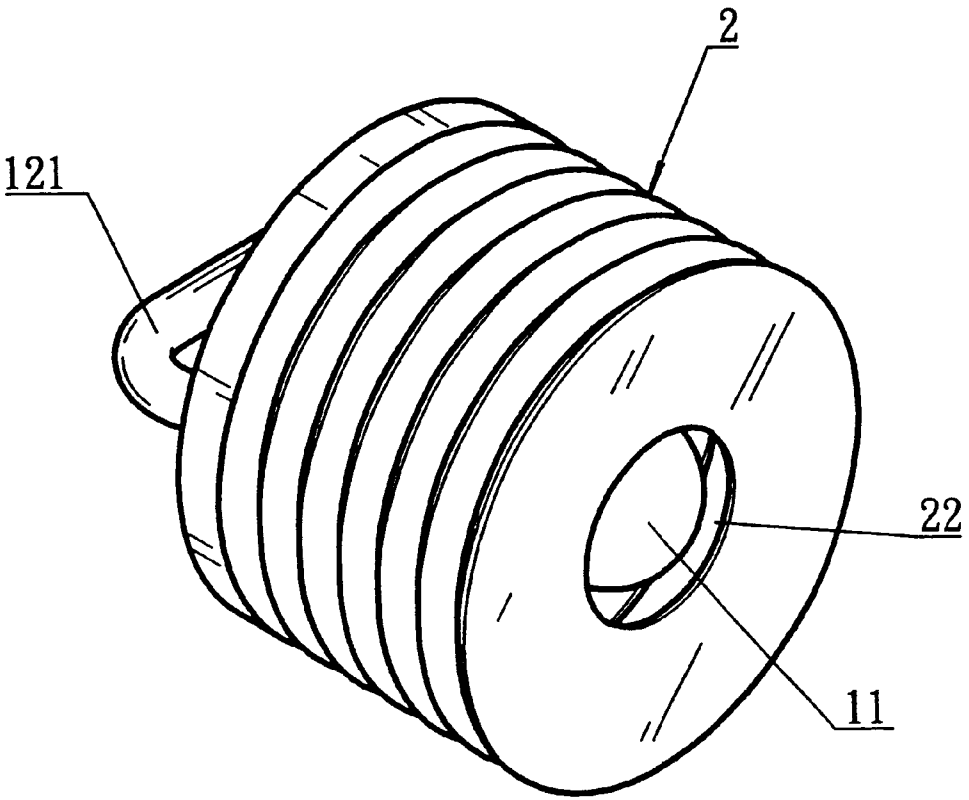
FIG. 2 is an isometric drawing of the invention herein.

Referring to FIG. 1 and FIG. 2, the drawings of the structural arrangement of the present invention, the invention herein is comprised of a nipple 1 and a protective sleeve 2 installed over the exterior section of the nipple 1, of which:

The nipple 1 has situated at one side a nursing end 11 and at the other side a round stay 12 and, furthermore, disposed on the round stay 12 is a grasping ring 121.

The protective sleeve 2 consists of a serpentine tubular structure surrounding the nipple 1 and having formed inside one end an annular engagement groove 21 and, furthermore, the annular engagement groove 21 is fitted onto the outer periphery of the round stay 12 of the nipple 1, with the other end having a through-hole 22 aligned with the position of the nursing end 11.

Figure 3:
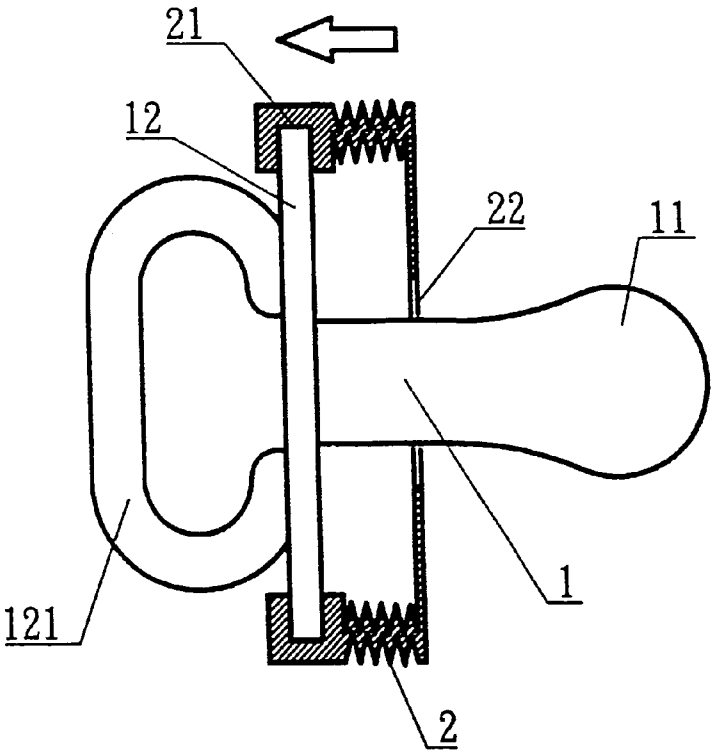
FIG. 3 is a cross-sectional drawing of the invention herein.
Figure 3:
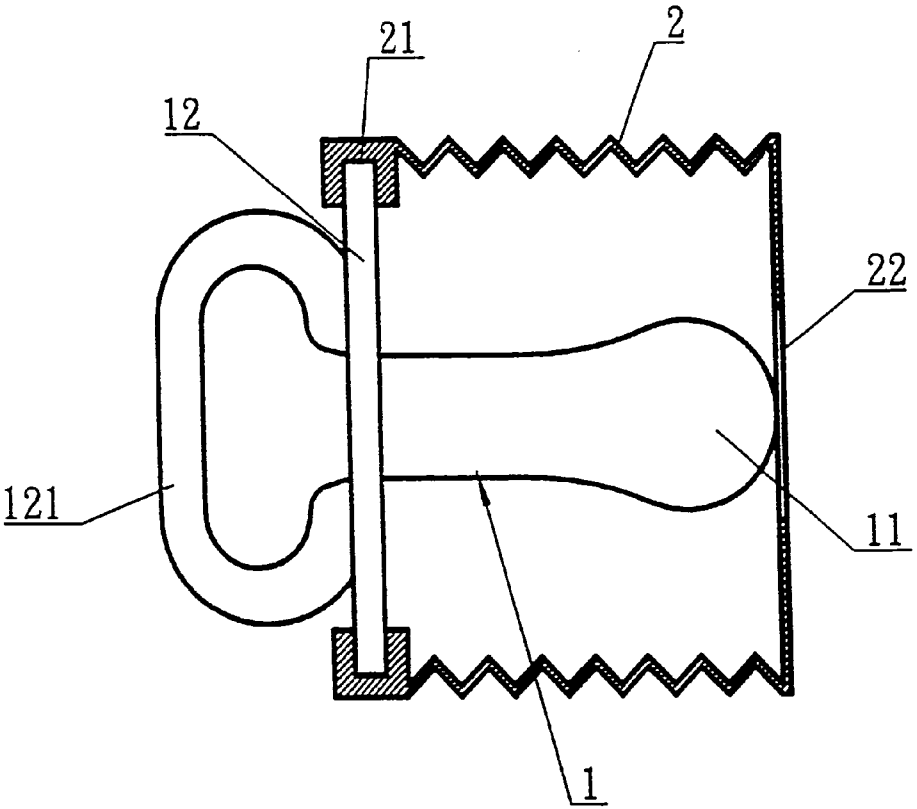
Figure 4:
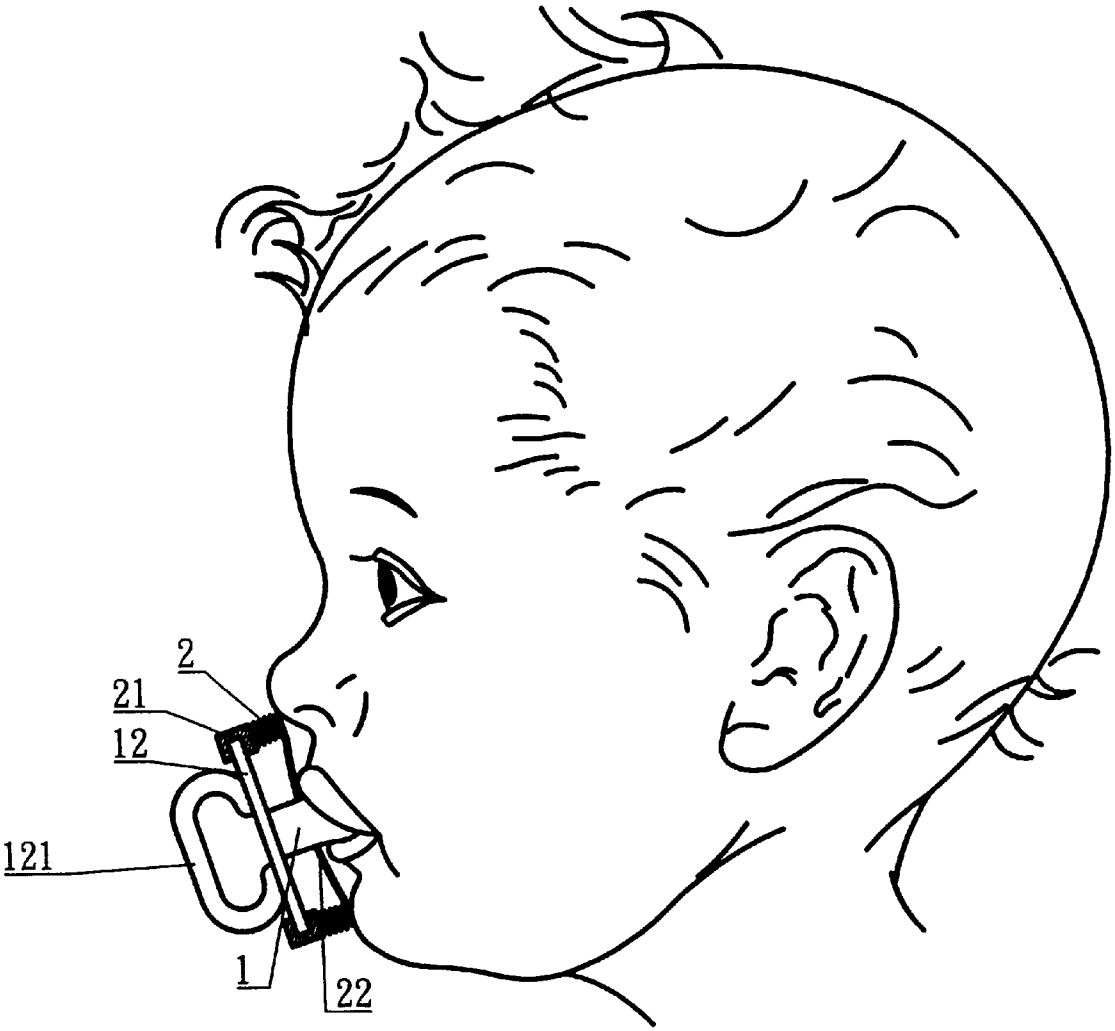
FIG. 4 is an orthographic drawing of the invention herein in a state of utilization.

Referring to FIG. 3 and FIG. 4, when the protective sleeve 2 is collapsed, the nursing end 11 of the nipple 1 projects outside the protective sleeve 2 through-hole 22 and provides for the suckling of the infant.

When the nipple 1 is removed from the mouth of the infant, the protective sleeve 2 is no longer compressed and the serpentine tubular structure immediately returns to its original shape, once again surrounding the exterior of the nipple 1 nursing end 11, as indicated in FIG. 3, such that when then pacifier nipple is dislodged, the nursing end 11 is prevented from contacting the floor, thereby functioning as a hygienic and safe protective pacifier nipple structure.

In summation of the forgoing section, since the protective pacifier nipple structure of the invention herein is capable of achieving of the claimed objectives, provides increased practical functionality that exceeds that of the conventional product.

What is claimed is:

1. A pacifier comprising:

a) a nipple having a nursing end and a round stay with an outer periphery;

b) a protective shield having a cylindrical configuration including a first end having a through hole enabling the passage of the nursing end of the nipple therethrough, an annular second end having a U-shaped cross-sectional configuration with an annular engagement groove engaging the outer periphery of the nipple so as to attach the shield to the nipple, and a side wall having a serpentine tubular configuration connecting the first and second ends, the serpentine tubular side wall enabling movement of the first end between a first position wherein the nursing end is enclosed by the shield and a second position wherein the nursing end is exposed through the through hole.

* * * * *